United States Patent [19]

Quiogue

[11] Patent Number: 4,473,873

[45] Date of Patent: Sep. 25, 1984

[54] LEVELING LUMINAIRE HANGER

[75] Inventor: Honesto D. Quiogue, Blacksburg, Va.

[73] Assignee: Harvey Hubbell Incorporated, Orange, Conn.

[21] Appl. No.: 523,043

[22] Filed: Aug. 15, 1983

[51] Int. Cl.[3] ..... F21S 1/04

[52] U.S. Cl. ..... 362/404; 362/418; 362/427; 362/431; 362/147; 248/324

[58] Field of Search ..... 362/404, 418, 427, 431, 362/147; 248/324

[56] References Cited

U.S. PATENT DOCUMENTS

| | | | |
|---|---|---|---|
| 2,347,113 | 4/1944 | King | 248/343 |
| 3,551,667 | 12/1970 | Husby | 240/3 |
| 3,643,088 | 2/1972 | Osteen | 240/52 |
| 4,161,019 | 7/1979 | Mulvey | 362/365 X |
| 4,237,530 | 12/1980 | Murray et al. | 362/391 X |
| 4,280,170 | 7/1981 | Baldwin | 362/368 X |
| 4,286,313 | 8/1981 | Quiogue | 362/370 |

*Primary Examiner*—Stephen J. Lechert, Jr.

*Attorney, Agent, or Firm*—Jerry M. Presson; Walter C. Farley

[57] ABSTRACT

A luminaire hanger includes a link having an opening to hang on a hook and a connector coupled to the lower end of the link for supporting an offset load. The connector has a circular boss which fits into a circular recess in the link, the two being clamped together by a bolt. The boss and recess are surrounded by serrations to prevent relative rotation when they are clamped together. When released, the link and connector can be angularly adjusted to put the suspension opening above the center of gravity of the load to support the load in a level fashion.

12 Claims, 7 Drawing Figures

LEVELING LUMINAIRE HANGER

This invention relates to a leveling hanger device for supporting and leveling a load, such as a luminaire, which can have a center of gravity offset from the support location.

BACKGROUND OF THE INVENTION

In general, industrial luminaires which are designed to be used indoors are arranged with appropriate hardware to hang the luminaire from a hook or rod, commonly near a ceiling. This is ordinary practice with luminaires using high intensity discharge lamps such as mercury vapor, metal halide and high pressure sodium. Such lamps have a ballast, such as a transformer, to step the available line voltage up to a level which is sufficient to properly energize the lamp. Most applications for such devices also require a current power factor correction device which can include a capacitor, and other components are also used, such as a starter or ignitor. A wide variety of circuit arrangements are available, and the various components which are used vary in size from one manufacturer to another. Additionally, the ballasts and capacitors differ in weight in accordance with different lamp wattages and lamp types.

These components, however, need to be fitted into a common housing commonly made out of die cast aluminum, fabricated sheet metal or extruded metal. Beneath the housing is a lamp holder to accept the lamp. To fully utilize the light emitted by the lamp, a formed or spun reflector is attached below the housing and above and around the lamp to reflect the light with directional control.

Unfortunately, because of the variety of different components having different weights, such luminaires tend to be unbalanced when they are suspended such that when the luminaire is placed in a horizontal position the center of gravity is laterally offset to a significant extent from the connection location which is a part of the housing and which, commonly, also provides a passageway for wires to enter the housing from the power source. Thus, when the luminaire is suspended, the housing swings until the center of gravity reaches a point directly below the point of suspension. This situation becomes a problem in the actual application because it projects the beam of light away from vertical or away from some other desired direction. Thus, it creates an uncontrolled beam distribution in addition to the fact that the tilting hanging luminaires are visually unacceptable.

This general problem has been recognized and various approaches have been taken to overcome the problem but with results which are not fully acceptable. One technique involves stacking all of the component parts such that their centers of gravity coincide essentially along one axis. While this technique works, it has the disadvantage of making the overall height of the luminaire considerably greater. Others use a dead weight the only function of which is to counterbalance, thus requiring various weights to match different sizes of ballast. Another luminaire is equipped with a fitting structure held with a plurality of bolts on a slotted track so that one can adjust the distance of the support with relation to the center of gravity to compensate for the weight unbalance. Other installations use simply a piece of string or wire to pull the fixture to its plumbed position, also a visually unacceptable solution.

Examples of prior art structures are found in the following U.S. patents.

U.S. Pat. No. 2,347,113 to King;
U.S. Pat. No. 3,551,667 to Husby;
U.S. Pat. No. 3,643,088 to Osteen et al.;
U.S. Pat. No. 4,186,433 to Baldwin;
U.S. Pat. No. 4,286,313 to Quioque.

BRIEF SUMMARY OF THE INVENTION

Accordingly, an object of the present invention is to provide a hanger for suspending an unbalanced load such as a luminaire in a way which permits the luminaire to be leveled with a simple adjustment of the hanger structure.

A further object is to provide such a hanger which does not involve complicated adjustments and which can accommodate components of a wide variety of sizes and distributions and which is sufficiently sturdy to reliably support units of substantial weight.

A further object is to provide such a device which has a minimum number of relatively simple components and is simple and inexpensive to produce.

Briefly described, the invention includes an adjustable hanger for leveling and supporting a load such as a luminaire from a suspension member such as a hook, the luminaire being of the type having a housing with an attachment device fixedly located thereon and having a center of gravity laterally offset an indeterminate distance from the attachment device, comprising an elongated link having means at one end defining a first opening for freely engaging the suspension member and means at the other end defining a second opening therethrough having an axis parallel with the axis of said first opening; a connector having means at one end for fixedly engaging the attachment device on said housing and means at the other end defining a third opening therethrough; a circular boss formed on one of said link and connector concentrically surrounding one of said second and third openings; a circular recess formed in the other of said link and connector concentrically surrounding the other one of said second and third openings, said recess being dimensioned to receive said boss such that the axes of said second and third openings are aligned and said link and connector are relatively rotatable about said aligned axes; and tightenable and releasable fastener means extending through said aligned openings for clamping said boss and recess together with said link and connection in a selected angular relationship so that the contact point of said first opening on the suspension member lies vertically above the center of gravity.

In order that the manner in which the foregoing and other objects are attained in accordance with the invention can be understood in detail, a particularly advantageous embodiment thereof will be described with reference to the accompanying drawings, which form a part of this specification, and wherein.

DETAILED DESCRIPTION OF A PREFERRED EMBODIMENT

Figure 1:
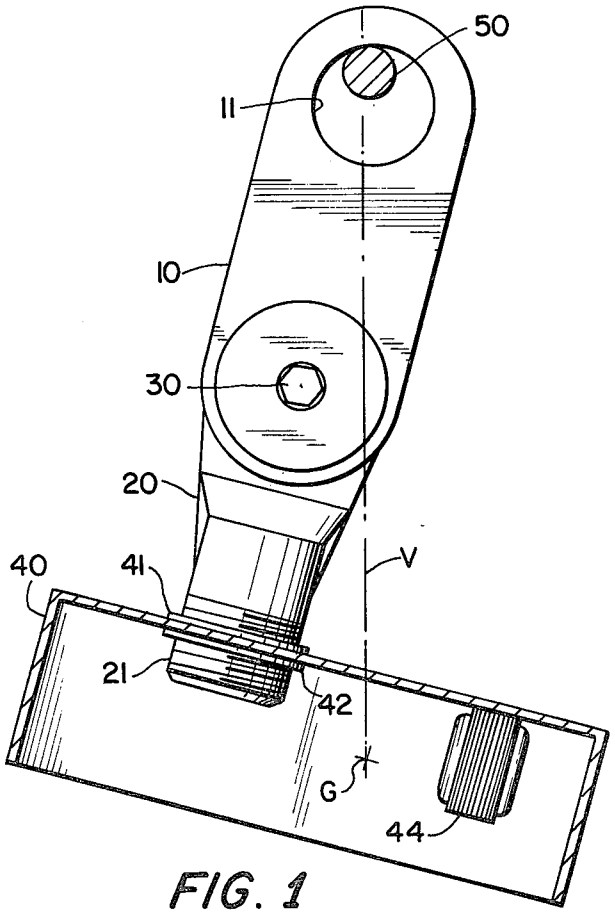
FIG. 1 is a front elevation of a hanger in accordance with the invention shown supporting a load in an unbalanced fashion.

As shown in FIG. 1, a hanger in accordance with the invention includes a link 10, a connector 20 and a fastener means shown as a bolt 30 which pivotally connects the link to the connector in a manner which will be more fully described. The lower end of the connector has a threaded portion 21 which extends through an opening in a load 40 and is coupled thereto by a nipple or a pair of internally threaded washers 41 and 42. As will be recognized, load 40 is a much simplified symbolic representation of a luminaire housing of a type normally used to contain components such as a ballast 44 for operating a high intensity discharge lamp. The housing is not intended to represent any specific form of housing, but merely to illustrate a housing which has an offset load arranged such that the center of gravity of the housing, indicated at G, is laterally offset from the attachment device fixedly located thereon for the purpose of receiving threaded portion 21 of the connector or of some other kind of hanging device.

With the longitudinal axis of link 10 aligned with that of connector 20 and with bolt 30 tightened so as to clamp the two members together to form an essentially rigid member, the structure functions somewhat like the prior art. Thus, link 10 is provided with means defining an opening 11 near one end thereof to engage a hook or rod-like suspension member 50. If allowed to swing and settle to its naturally stable position, the assembly will end up in a position such that the contact point between suspension member 50 and opening 11 will lie vertically above the center of gravity G, the vertical line therebetween being indicated by the phantom line V. As previously indicated, in this condition the lamp and reflector carried by the housing are tilted in a visually undesirable and generally uncontrolled fashion.

Figure 3:
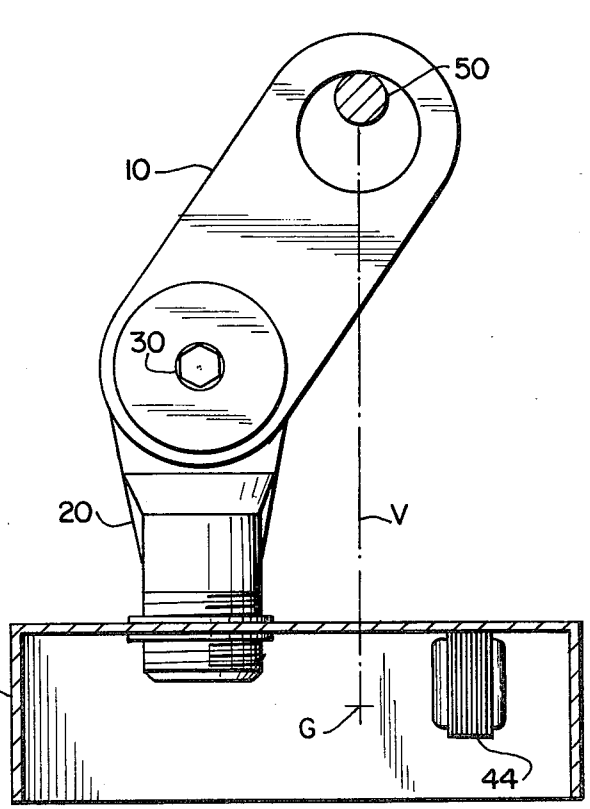
FIGS. 2 and 3 are front elevations of the hanger of FIG. 1 showing the adjustment thereof.
Figure 2:
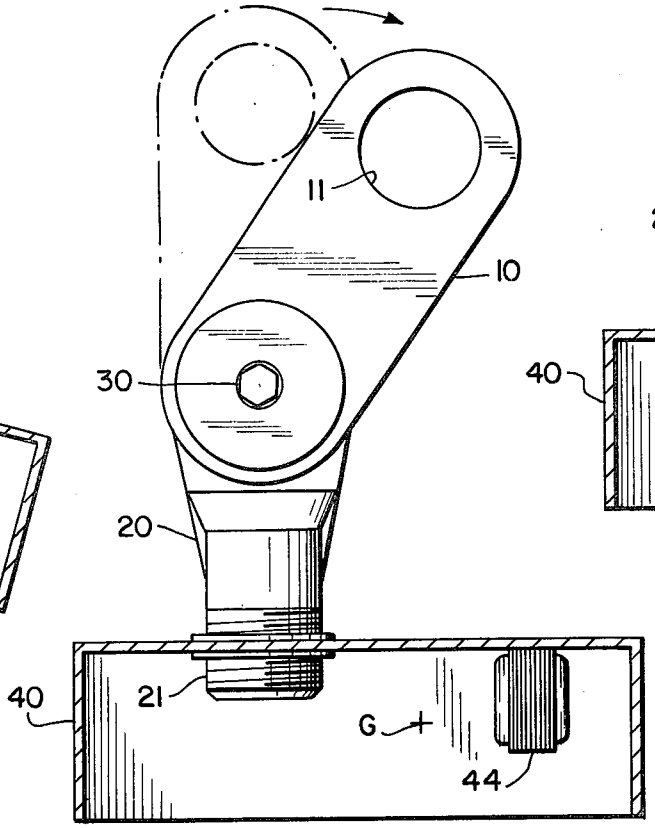

In accordance with the invention, the longitudinal axis of link 10 can be adjusted relative to that of connector 20 as illustrated in FIG. 2 so that the center of gravity of housing 40 lies vertically beneath the highest point of opening 11 so that when opening 11 is placed over a suspension member 50 the central axis of that member will lie directly above the center of gravity as illustrated in FIG. 3, permitting the hanger to support the housing in a level, horizontal fashion.

Figure 4:
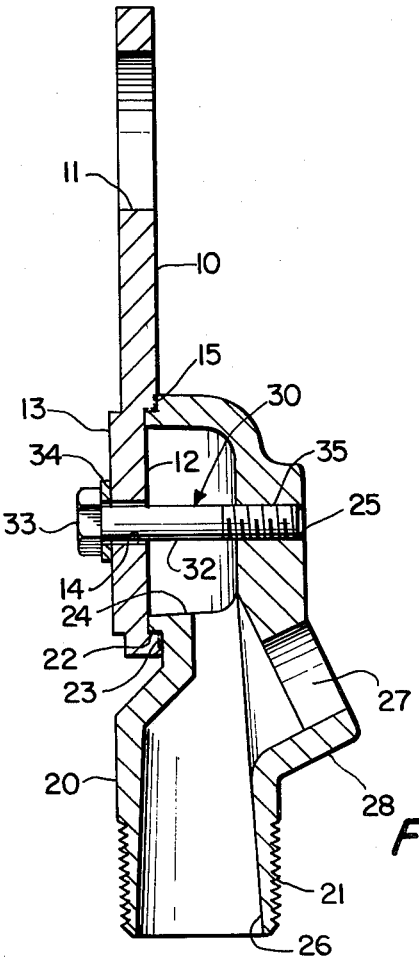
FIG. 4 is a side elevation, in partial section, of the hanger of FIGS. 1–3.

It is important, however, for the hanger to also be structured in such a way that the angular adjustment such as that shown in FIG. 2 will be maintained and so that the weight of a large luminaire fixture, which can be quite substantial, can be supported by the hanger in a reliable manner. The structural features which permit this relationship and the advantages thereof to be attained will be more clearly seen in FIGS. 4–7. FIG. 4 shows the hanger including link 10 and connector 20 with their axes essentially aligned as shown in FIG. 1. As will also be seen in FIG. 5, link 10 is a generally elongated member having rounded ends and having an opening 11 therethrough near the upper end, as described. Near the lower end of link 10 the rear face is formed with a circular recess 12, the front face of the link having a circular boss 13, the purpose of which is to maintain the thickness of the link in the vicinity of the recess for strength purposes. A smooth, circular hole 14 passes through the link coaxially with the center of recess 12 to receive the shank of bolt 30. The enlarged head 33 of the bolt engages a spring washer 34 which is held between the head of the bolt and the face of boss 13. Spring washer 34 can be a conventional split washer, for example.

Figure 5:
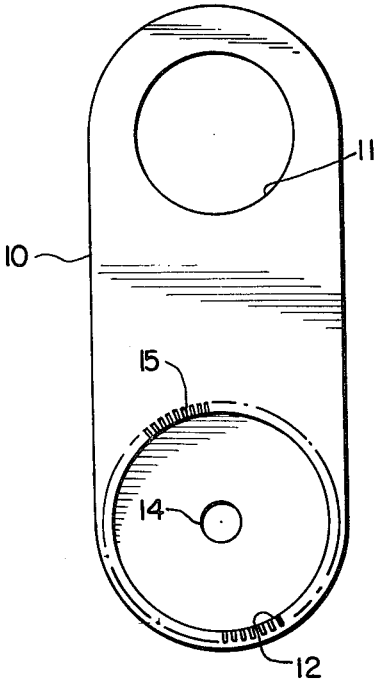
FIG. 5 is a rear elevation of the link portion of the hanger of FIGS. 1–4.
Figure 6:
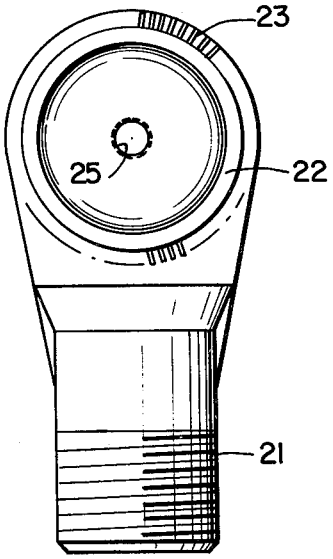
FIG. 6 is a front elevation of the connector portion of the hanger of FIGS. 1–4.
Figure 7:
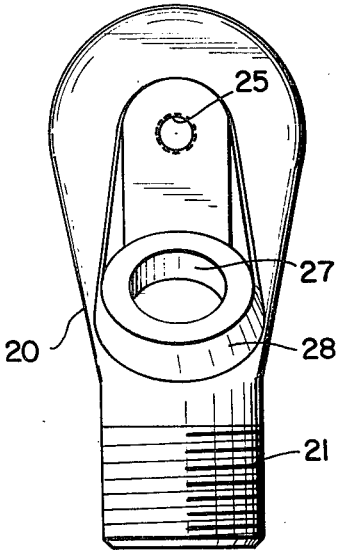
FIG. 7 is a rear elevation of the connector portion of the hanger of FIGS. 1–4.

As seen in FIGS. 4 and 5, the peripheral area immediately around recess 12 is provided with an annular series of radially extending serrations 15 which can be a continuous series of V-shaped notches or a sequence of castellations of rectangular shape.

Connector 20 is provided with an annular wall 22 forming a circular boss which is received within recess 12. Boss 22 is dimensioned to be rather tightly received within the recess, but not so tightly that the members cannot be rotated relative to each other. Immediately surrounding boss 22, connector 20 is provided with a plurality of serrations 23 which are shaped to engage serrations 15 so that when the members are clamped tightly together the serrations engage each other and relative rotation is prevented. Within boss 22 is a cavity 24 which permits the threaded end 35 and shank 32 of bolt 30 to pass therethrough and at the back of the connector is an internally threaded opening 25 to receive and engage threaded end 35. Thus, threading bolt 30 into opening 25 permits the head 33 of the bolt to press against washer 34 and force the link against the connector, engaging the serrations 15 and 23 to prevent rotation. Loosening the bolt permits the members to be rotated relatively, adjusting the angular relationship as described in connection with FIGS. 2 and 3.

As previously mentioned, the lower end of connector 20 is provided with external threads 21. The interior of the lower end of connector 20 has a passageway 26 which extends upwardly through the connector and opens outwardly at a tubular opening 27 at the rear of connector 20. Thus, electrical conductors to be connected to components within housing 40 can be passed inwardly through opening 27 and out of the bottom of passageway 26, into the interior of the housing.

It is particularly significant to recognize that the interengagement of recess 12 with boss 22 permits the load attached to the threads of connector 20 to be passed directly from strong portions of the connector to similarly strong portions of the link, conveying the load to opening 11 and suspension member 50. Thus, the bolt 30 need only perform the function of clamping the members together and absorbs substantially none of the weight load by shear stresses along its shank. The provision of spring washer 34 permits the link and connector to be angularly adjusted while the bolt is loosened, without the need for the bolt to be entirely removed.

Because of the fact that luminaires of the type with which the invention is concerned are commonly to be suspended at a considerable height above the floor of a chamber such as a gymnasium or large auditorium, it is highly desirable to be able to make whatever adjustments are necessary before the luminaire is mounted. Thus, referring again to FIGS. 1 and 2, it is convenient to simply pass a rod through opening 11, simulating the presence of suspension member 50, and hold the rod with one's hands while observing the tilt of the luminaire housing. Bolt 30 can then be loosened and the adjustment made, after which the rod can be lifted again to check the accuracy of the adjustment which can then be refined, if necessary. A bubble level can, of course, be used to improve the accuracy of this adjustment over simple observation. After the adjustment has been made and bolt 30 tightened to engage serrations 15, 23, the device can be lifted to its destination and suspended without further adjustment. The invention thus permits a rapid, simple and safe adjustment and mounting process.

While one advantageous embodiment has been chosen to illustrate the invention it will be understood by those skilled in the art that various changes and modifications can be made therein without departing from the scope of the invention as defined in the appended claims.

I claim:

1. An adjustable hanger for leveling and supporting a load such as a luminaire from a suspension member such as a hook, the luminaire being of the type having a housing with an attachment device fixedly located thereon and having a center of gravity laterally offset an indeterminate distance from the attachment device, comprising an elongated link having means at one end defining a first opening for freely engaging the suspension member and means at the other end defining a second opening therethrough having an axis parallel with the axis of said first opening;

a connector having means at one end for fixedly engaging the attachment device on said housing and means at the other end defining a third opening therethrough;

a circular boss formed on one of said link and connector concentrically surrounding one of said second and third openings;

a circular recess formed in the other of said link and connector concentrically surrounding the other one of said second and third openings, said recess being dimensioned to receive said boss such that the axes of said second and third openings are aligned and said link and connector are relatively rotatable about said aligned axes; and tightenable and releasable fastener means extending through said aligned openings for clamping said boss and recess together with said link and connection in a selected angular relationship so that the contact point of said first opening on the suspension member lies vertically above the center of gravity.

2. An apparatus according to claim 1 and further comprising a plurality of radial serrations formed around each of said boss and said recess to enhance locking thereof when said link and connector are clamped together.

3. An apparatus according to claim 2 wherein said fastener means includes a bolt having an enlarged head at one end and threads at the other.

4. An apparatus according to claim 3 wherein one of said second and third openings is an internally threaded hole and the other is smooth.

5. An apparatus according to claim 4 wherein said load is a luminaire and said housing contains electrical components for use with a lamp, said connector including means defining a wire passage from an outside location to within said housing.

6. An apparatus according to claim 5 wherein said fastener means includes a spring washer, said bolt extending through said smooth opening and engaging said threaded opening with said washer between said head and the one of said link and connector having said smooth opening.

7. An apparatus according to claim 4 wherein said fastener means includes a spring washer, said bolt extending through said smooth opening and engaging said threaded opening with said washer between said head and the one of said link and connector having said smooth opening.

8. An apparatus according to claim 3 wherein said load is a luminaire and said housing contains electrical components for use with a lamp, said connector including means defining a wire passage from an outside location to within said housing.

9. An apparatus according to claim 2 wherein said load is a luminaire and said housing contains electrical components for use with a lamp, said connector including means defining a wire passage from an outside location to within said housing.

10. An apparatus according to claim 2 wherein one of said second and third openings is an internally threaded hole and the other is smooth.

11. An apparatus according to claim 1 wherein one of said second and third openings is an internally threaded hole and the other is smooth.

12. An apparatus according to claim 1 wherein said fastener means includes a bolt having an enlarged head at one end and threads at the other.

* * * * *